United States Patent [19]

Huguet

[11] 4,154,030

[45] May 15, 1979

[54] PREFAB PANELS AND SYSTEM FOR BUILDING CONSTRUCTION

[76] Inventor: Rafael R. Huguet, 39 NW. 40 Ct., Miami, Fla. 33126

[21] Appl. No.: 898,515

[22] Filed: Apr. 20, 1978

Related U.S. Application Data

[63] Continuation-in-part of Ser. No. 710,871, Aug. 2, 1976, abandoned, and a continuation-in-part of Ser. No. 594,879, Jul. 10, 1975, abandoned.

[51] Int. Cl.[2] ..... E04B 1/00; E04B 5/48; E04B 2/14

[52] U.S. Cl. ..... 52/98; 52/100; 52/221; 52/241; 52/281; 52/289; 52/300; 52/586

[58] Field of Search ..... 52/92, 98, 100, 241, 52/243, 281, 285, 309.6, 309.7, 309.8, 309.12, 221, 289, 300, 309.13, 586

[56] References Cited

U.S. PATENT DOCUMENTS

| | | | |
|---|---|---|---|
| 2,412,404 | 12/1946 | Jackson | 52/493 X |
| 2,495,862 | 1/1950 | Osborn | 52/580 |
| 3,254,464 | 6/1966 | Hoyt, Jr. | 52/309.9 |
| 3,307,312 | 3/1967 | Kreibaum | 52/303 |
| 3,386,221 | 6/1968 | Giovannucci | 52/586 |
| 3,440,785 | 4/1969 | Denny et al. | 52/241 X |
| 3,543,460 | 12/1970 | Stastny et al. | 52/309.7 |
| 3,720,026 | 3/1973 | Gasteiger | 52/241 |
| 3,744,199 | 7/1973 | Navarre | 52/241 X |
| 3,885,296 | 5/1975 | Stout | 52/221 X |
| 3,888,059 | 6/1975 | MacLennan et al. | 52/241 |

FOREIGN PATENT DOCUMENTS

| | | | |
|---|---|---|---|
| 283101 | 5/1965 | Australia | 52/586 |
| 2435129 | 2/1975 | Fed. Rep. of Germany | 52/586 |
| 2457483 | 6/1976 | Fed. Rep. of Germany | 52/309.9 |
| 1530016 | 5/1968 | France. | |
| 417630 | 1/1947 | Italy | 52/496 |
| 253663 | 11/1948 | Switzerland | 52/496 |
| 467671 | 6/1937 | United Kingdom | 52/615 |

*Primary Examiner*—Alfred C. Perham

[57] ABSTRACT

A prefabricated building construction composed of a plurality of columns and beams adapted to be interconnected to one another to form a rigid load-bearing structural frame and a plurality of inexpensive lightweight non-load-bearing panels spanning the frame components, and each panel being generally of slab form and having a top, bottom and side faces bounding an inside and outside main generally planar face, and said panels comprising a main portion of molded waste material and a resinous binder forming a polymer and the minor portion of open cell material in spaced parallel cylindrical shafts embedded within the main portion of molded waste material with the shafts extending from the top surface to the bottom surface and one of said shafts being adjacent each of the side surfaces, said frame components being substantially concealed within the panels defining waterproof seams wherein the frame components serve as waterproof panel connectors, each frame component along one of the seams comprising a portion extending depthwise through the confronting side surfaces of adjacent panels and into the cylindrical embedded shafts of open cell material and having enlarged outer ends within the shafts of open cell material.

13 Claims, 14 Drawing Figures

PREFAB PANELS AND SYSTEM FOR BUILDING CONSTRUCTION

This is a continuation-in-part of my earlier filed patent application Ser. No. 594,879 filed on July 1, 1975, now abandoned; and my continuation-in-part copending patent application Ser. No. 710,871 filed Aug. 2, 1976 now abandoned.

FIELD OF THE INVENTION

The present invention pertains to a prefabricated building construction which includes a plurality of panels and structural members which are of generally H-shape in cross section and which members serve two purposes: (1) the members when interconnected comprise a skeletal framework for a building, and (2) the members serve as waterproof connectors between adjacent panels. The panels are composed of two portions a main molded portion of inexpensive lightweight material and a binder in slab form and set in a relatively rigid body defining main generally planar faces between side surfaces and top and bottom surfaces; and secondly, longitudinally extending inner shafts within the panels parallel to and adjacent the side surfaces, the shafts being of open cell material or expandable materials which are embedded in the main portion in the manufacture of the panels by inserting them into the panel casting mold.

The same are for the purpose of erecting a prefabricated building construction.

THE INVENTION GENERALLY

Generally, the present invention pertains to a prefabricated building construction system which includes a plurality of molded panels and structural connector members wherein basic panels are composed of molding compound of an inexpensive lightweight waste material normally presenting planar outer surfaces and embedded shafts or inserts of longitudinally extending cylindrical sections composed of an open cell network of displaceable expandible materials which are embedded in the panel during the molding process at spaced parallel locations extending between the upper and lower panel surfaces and parallel to the side surfaces. More specifically, the inserts are relatively close, that is, adjacent the side surfaces of the panels to receive and house columns and beams shaped as waterproof connector means between the panels to form a concealed structural rigid frame capable of supporting a multi-story structure and meeting the most demanding requirements including the extreme limits of any seismic code and wherein the upper and lower ends of the columns extend outwardly of the panels a short distance for interconnection to a tie beam as gravity load-bearing members, and wherein the panel will not carry gravity loads and do act as a diaphragm to transfer lateral loads, such as wind and seismic forces to the foundaton.

BACKGROUND AND OBJECTS OF THE PRESENT INVENTION

Prefabricated units are synonymous of economy and speed in dwelling construction. Because transportation will result in additional time and charges, mostly depending on the scheduling and fees of freight companies, import duties, insurance rates, and other charges due to inadequate communication facilities, prefabricated units should be manufactured of an inexpensive raw material locally available in abundant supply, within a reasonable distance from the installation site, to be set in place by an unskilled laborer without the introduction of sophisticated technology and heavy equipment beyond the real capacities of each geographical location, thus meeting the essentials of prompt delivery, easy installation, and low cost requirements. The present invention meets the aforementioned principles.

In essence, the present invention deals with a prefabricated panel and a system for utilizing a plurality of the panels in building construction wherein the basic panels utilize different waste material as its main component. Available mostly anywhere in unlimited amounts, waste material may be found in factories and processing plants willing to pay for transportation to dumping sites thus making it possible to manufacture a rather inexpensive panel, which otherwise is not feasible to accomplish with customary building products such as steel, aluminum, gypsum board, drywall, concrete and others that in many cases are either very costly or not obtainable.

In the system the prefab panel is utilized as an exterior weatherproof wall or as an interior partition housing an independent, concealed structural rigid frame, capable of supporting a multi-story building and meeting the most demanding requirements, including the extreme limits of any seismic code. The concealed structural elements will act as waterproof connector means to join the abutting ends of adjacent panels, by interconnecting the two parallel sides of the panels. In addition to exterior walls and interior partitions the panels may be used as roofing panels and for a variety of architectural purposes.

The present invention includes a prefabricated panel to be utilized in a building construction wherein the panel is composed of a (1) main molded porton of suitable waste material bound together by a suitable carrier, such as a polymer in a slab form that is in a parallelepedal shape with parallel top, bottom and parallel side surfaces connected together on opposite sides of a main inner and main outer planar surface and there are shafts of open cell expandable material embedded in the main portion and parallel to the side surfaces extending between the top and bottom surface between the planar surfaces which are inserted during the molding process.

In use, the panels are utilized as non-load bearing members in the sense that they do not carry gravity loads and the panels are utilized to span the load bearing members of a rigid building form and the panels are utilized as exterior and interior walls for the skeletal framework only acting as a diaphragm transferring lateral loads to the foundation. The building's rigid frame is capable of supporting a multi-story building and meeting demanding requirements of building codes and the vertical members are of H-shaped cross section extending vertically outwardly of the panels for interconnection with the other rigid skeletal framework members. The concealed structural elements also act as waterproof connector means to adjoin abutting side surfaces of adjacent panels extending perpendicularly of the side surfaces and into the inserts wherein the enlarged portions of the connector means are positioned. The panels may also be used not only as walls but as roofing panels and for a wide variety of architectural purposes.

One of the principal objects of the present invention is to provide a prefabricated panel for building construction which utilizes an inexpensive lightweight waste material including sawdust, rice-straw, remains of sugar cane, cardboard, paper, and other inexpensive products as its main component, acting as a filler mixed with a suitable binder or a base such as P.V.C. polyethylene, epoxies, cement, starch, etc. to form a polymer that may be casted together with cylindrical sections of a different compound of an open cell network of displaceable expandable characteristics, such as polyurethane, polysterene, and other foam plastics placed at different intervals and extending between the ends of the panels to receive the house concealed structural members and conduits and that the polymer can be supplemented with other fillers suchas ground asbestos to make a compound that resists burning, ground quartz or mica to make it hard, and other aggregates to make it consistent with product needs and requirements.

Another principal object of this invention is to provide a prefabricated panel and construction system which may be constructed of a variety of lightweight molding compounds made of waste material which will be easy to handle and set in place and interconnect to an adjoining panel by an individual laborer, and that may be consistent with product needs and requirements to enhance several properties including but not limited to the manufacture of a panel that may be noncorrosive, moisture proof, fire retardant, insect repellant, that may accept screws, pop rivets, and nails with a perfect grip, and other characteristics not unifiable in prefabricated panels made of metal, wood, concrete or gypsum products.

Yet another object of this invention is to provide a prefabriated panel and construction system in which the panel may be cut in dimensions other than its modular size, maintaining its original properties, and allowing for versatility of design by providing irregular size fillers that may be interconnected to adjoining panels, whereby all exterior joints may be filled, repaired and covered with the proper cement compount, and providing for all exterior surfacing of the walls to bear the same finish.

Another object of the instant invention is to provide a prefabricated panel and construction system in which the panel may bear a permanent color by adding a pigment or a dye to the molding compound, and that it may be manufactured and assembled in a factory and all prefab conduits and ducts may be housed within the panel, and window openings may be cut to provide for a fast and simple installaton method at job site.

Another principal object of the present invention is to provide a prefabricated panel and construction system in which longitudinally extending cylindrical shafts are provided adjacent the side surface of an open cell network of displaceable foam material to receive conduits and ducts or to interconnect two panels when joined by a structural element as shown in the drawings.

Another object of the present invention is to provide a prefabricated panel and construction system in which the panels may be interconnected by means of columns of length longer than the height of the panels to receive gravity load and permit factory errors in panels.

A still further object of the present invention is to provide a prefabricated panel and a system in which a wide variety of architectural finishes may be provided by the molding process, creating any desired pattern in the walls for aesthetic purposes and yet showing no exposure of metal structural members housed within the panel that otherwise may transmit thermal conditions to interior surfaces, allowing for all exterior walls to be uniformly coated in any conventional maner which is difficult to attain in metal and wood products.

Yet another principal object of this invention is to provide a prefabricated panel and construction system in which the panel may be utilized as a non-load exterior weatherproof panel, an interior panel, a horizontal floor panel, a roofing panel, and for a variety of other architectural purposes, housing an independent concealed structural rigid frame interconnecting adjacent coplanar panels and capable of supporting a multi-story building and meeting the most demanding requirements including the extreme limits of any seismic code, and reaching long spans not feasible with other prefab systems.

Another principal object of the present invention is to provide a prefabricated panel and construction system in which the concealed structural elements sized to engage between the confronting edges of two panels in a manner so as to prevent any relative longitudinal or lateral movement between the panels may act as waterproof connector means, as conduits and ducts, and as further means to interconnect the two parallel outer surfaces of the panel.

A still further principal object of the present invention is to provide a separate panel connector or column that may be formed from wood products or it may be roll formed from metal sheets, such as galvanized steel, aluminum, etc., into an H structural shape that will further serve as a waterproof connector means, and to interconnect the two parallel outer surfaces of the panels at a cheaper and simpler method than other prefab systems.

Another object of the present invention is to provide a prefabricated panel and construction system in which an effective method of construction may be accomplished by an unskilled laborer without introducing high technology and sophisticated methods beyond the capacity of a common individual.

It is a further object of this invention to provide a means to act as a cap and a base beam for the prefabricated panels when the same have been connected together by the waterproof connector means which is composed of a generally channel-shaped elongate member with ledges extending from the flanges of the members defining abutment surfaces for the panels and between the flanges of which the panels dwell and are captivated by suitable means spanning the flanges and extending through the panels, such as bolts and pop rivets. As shown in FIGS. 10, 11 and 12 of the drawings, it is seen that the construction has as an object the supporting of adjacent panels on the ledges and that the waterproof connector columns extend outwardly of the top and bottom surfaces of the panels respectively to a different level than the adjacent surface of the panel to support the structural cap or tie beam and thus the gravity load of the structure is carried by the waterproof connector columns and the tie beam structure.

In accordance with these and other objects which will become apparent hereinafter, the instant invention will now be described with reference to the accompanying drawings, in which:

DESCRIPTION OF PREFERRED EMBODIMENTS

Figure 1:
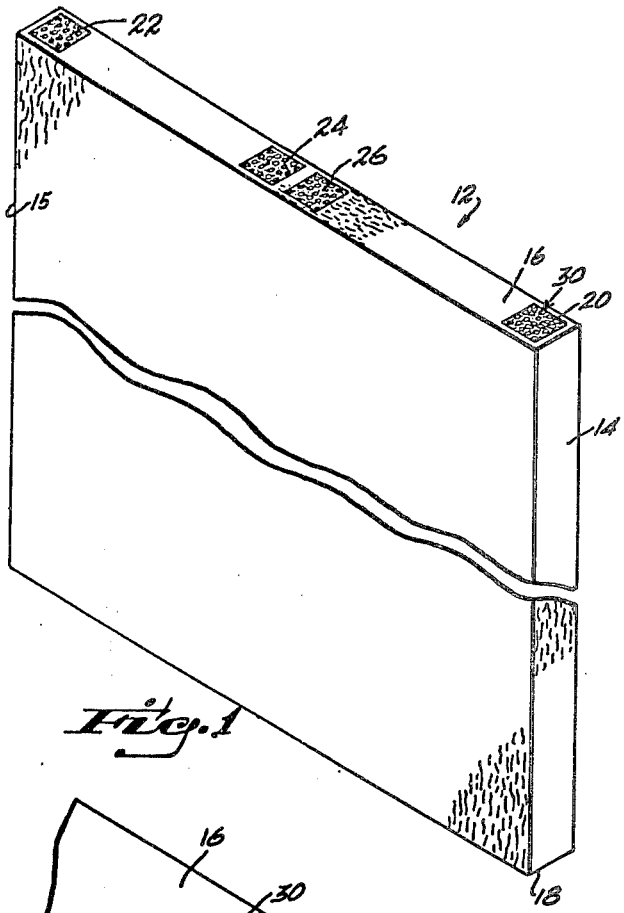
FIG. 1 is a perspective view of a panel constructed in accordance with this invention.
Figure 2:
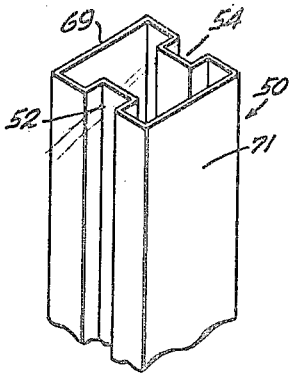
FIGS. 2, 3, 4 and 5 are alternative embodiments of columns for use in accordance with this invention.
Figure 3:
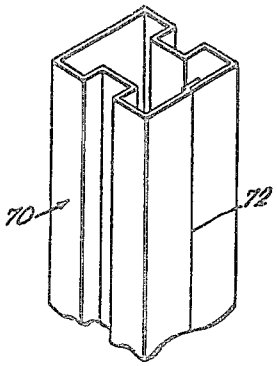
Figure 4:
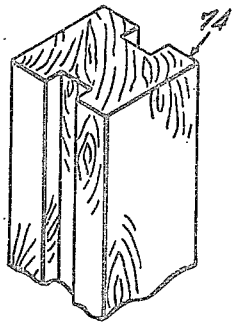
Figure 5:
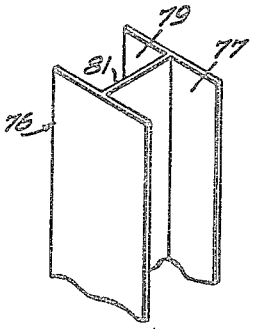
Figure 6:
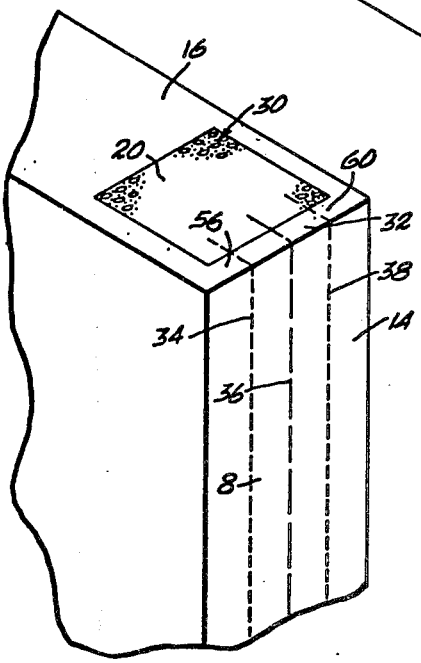
FIG. 6 is a partial perspective view of the upper right-hand corner of the panel shown in FIG. 1.
Figure 7:
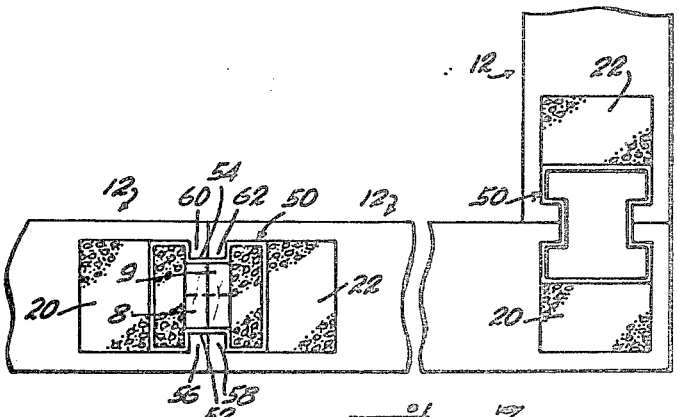
FIG. 7 is a top plan view of a corner installation and a juncture of coplanar panels of the type shown in FIG. 1 and shown in an enlarged view in combination with the columns of FIG. 2.
Figure 8:
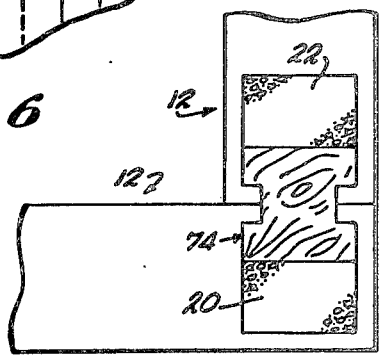
FIG. 8 is a view similar to FIG. 7 and illustrating the panels joined together utilizing the column of FIG. 4.
Figure 9:
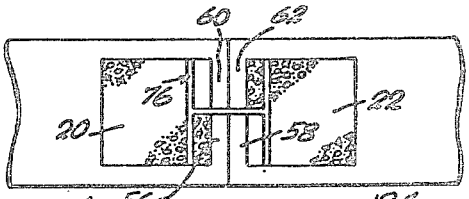
FIG. 9 is a view similar to FIG. 7 and illustrating the panels joined together with a column similar to that shown in FIG. 5.

Referring to the drawings shown in FIG. 1, there is shown a panel generally designated by the numeral 12 having longitudinally extending side surfaces such as that designated by the numeral 14 and 15 and an upper surface 16 and a lower surface 18. Adjacent the side surfaces, such as the surface 14, there is a longitudinally extending recess of different material than the main portion of the panel which is positioned or inserted into the main panel during the molding process. This insert or cylindrical shaft 20 extends from the upper surface to the lower surface. A longitudinally extending shaft 22 is provided adjacent the side surface 15. In the preferred embodiment two additional shafts are provided, as designated by the numerals 24 and 26, and these are parallel to one another and slightly spaced apart from one another in the middle region between the side surfaces 14 and 15. The main portion of the panels is composed of a set and cured molded combination of lightweight waste materials suitably bound together by a resin or other binder. During the molding operation the cylindrical shafts extending between the upper and lower surfaces are embedded in parallel alignment with the side surfaces as are the intermediate shafts 24 and 26. The inserts or cylindrical shafts are of polyurethane foam material of an open cell character or any other type of open celluar lightweight filler material, the same being designated by the numeral 30 in FIG. 6. The space designated by the numeral 32 between the shaft and the side surface adjacent to it, such as the side surface 14 in FIG. 6 is adapted to be cut conveniently along the lines 34, 36 or 38 at a job site for easy transportation preventing damages. The panels are connected together in assembly by columns such as 50 with side pockets 52 and 54 to receive wing zones 56 and 58 and 60 and 62 of adjacent panels, as shown in FIGS. 7, 8 and 9 comprising plan views and illustrating the waterproof connection at the seams of abutting or adjacent panels. As an alternative, the columns may be such as that shown in FIG. 3 and designated by the numeral 70 in which case the same are of roll formed material being joined along a line of juncture 72 and in overlapped relation with the inner portion of the overlapped zone being recessed slightly so as to define a smooth outer surface. Alternatively, these columns may be solid as indicated by the numeral 74. It is seen that in each of these embodiments shown in FIGS. 2, 3 and 4 of the column, there are the characteristic side pockets 52 and 54 extending longitudinally thereof so as to define the waterproof barrier between adjacent panels and within these pockets the wing zones 56 and 58, 60 and 62 of adjacent panels are received with the outer surfaces 69 and 71 of the columns being received within the cylindrical shafts. It can be considered that all of the embodiments shown in FIGS. 2–4, as well as the embodiment shown in FIG. 5 are of H-beam shape, including that designated by the numeral 76 in FIG. 5. In the latter embodiment, the pockets being designated by the numerals 77 and 79 and the web being designated by the numeral 81 which comprises the waterproof barrier. In any event, these columns are of a length greater than that of the panel, so that a portion extends outwardly of the end of the panels. These columns are utilized in the fashion shown in FIGS. 7, 8 and 9 to define waterproof seams between adjacent panels. Each of the exterior columns is of a length slightly longer than the overall length H of the panel, see FIG. 10, so that a lower porton 90 and an upper portion 92 extend outwardly of the upper and lower panel surfaces and out of the open cell cylindrical shafts or inserts. In use, the cuts 34, 36, and 38 as appropriate are made and, thereafter, as an important feature or object, the columns may simply be forced into the open cell shafts by hammering or pounding them in a parallel direction until the relative position with respect to one another shown in FIG. 10, that is with a portion of the connector member extending from the top and a portion extending from the bottom. This process cuts through the embedded open cell material after the cuts 34, 36, and 38 have been provided. It should be noted that the thickness of the cuts 34, 36 and 38 may be substantially the same as but slightly greater than the thickness of the wall thickness of the connector and, after the columns have been forced into position by hammering or pounding them, the column is filled with the open cell material and the portions designated by the numerals 8 and 9 adhere to the open cell material and do not fall away merely because the cuts have been made. Thus, the interior hollow of the columns in the case of the types shown in FIGS. 2 and 3 are filled and the columns or beams are surrounded exteriorly as well thus improving the overall structural characteristics of the column or beam.

Figure 10:
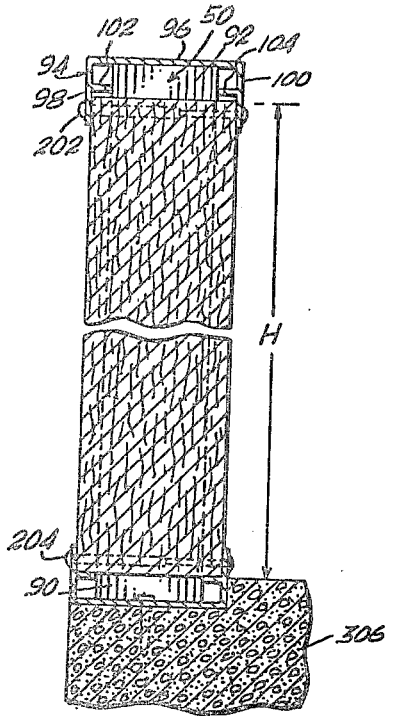
FIG. 10 is a view in cross section illustrating a panel constructed in accordance with that shown in FIG. 1 attached to a footing and capped by a metal member.
Figure 11:
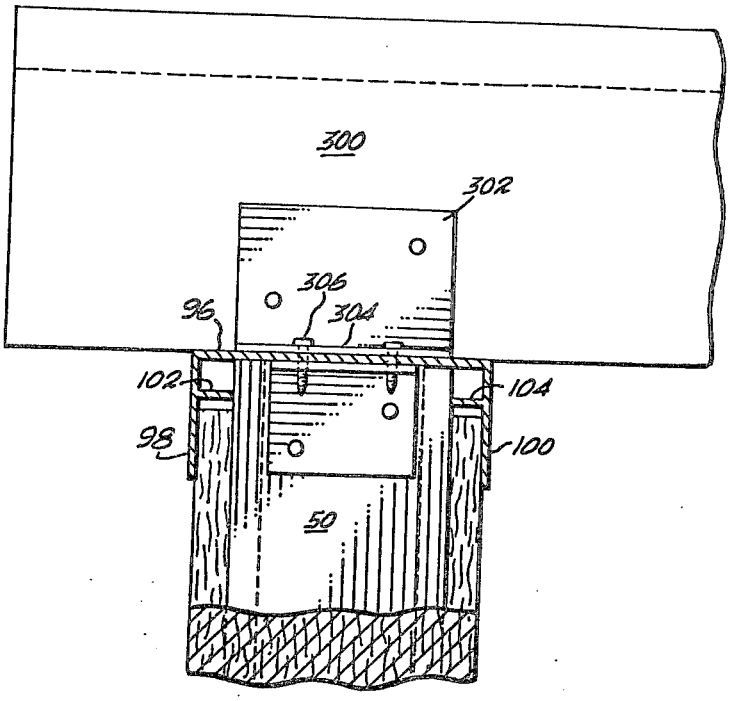
FIG. 11 is an enlarged view of the upper end of a panel capped as in FIG. 10 and supporting a rafter.
Figure 12:
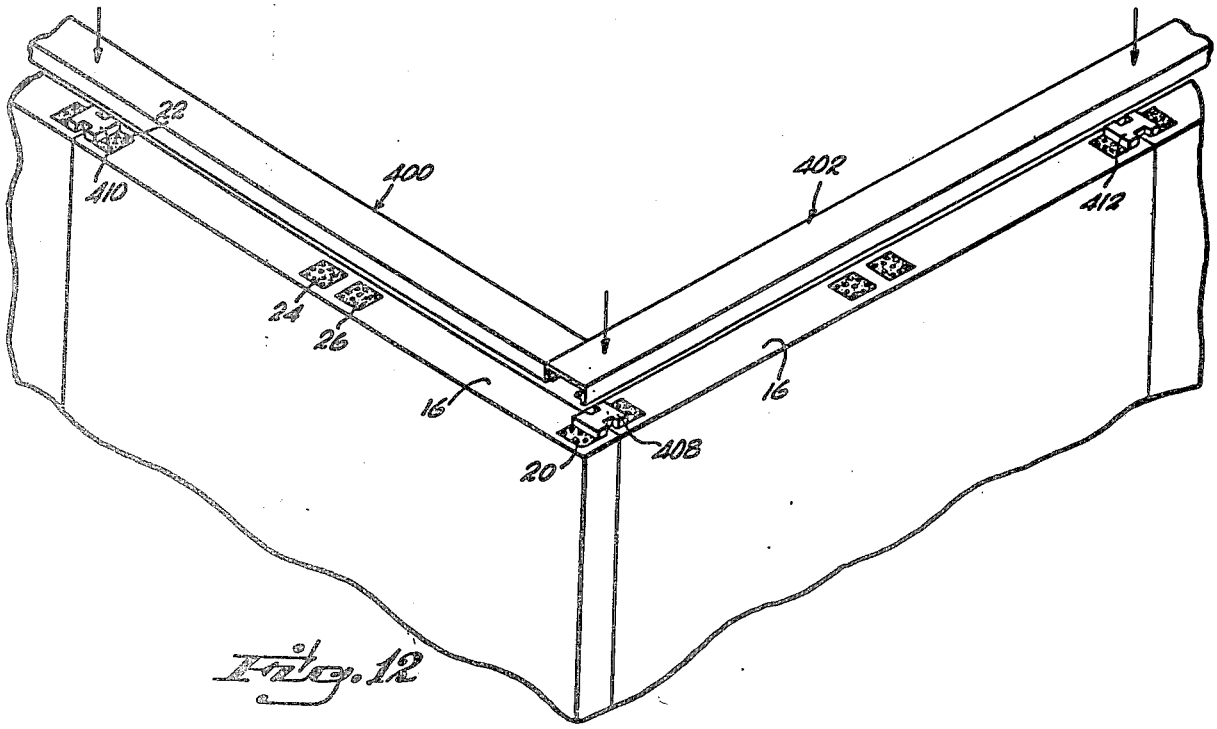
FIG. 12 is a partial view in perspective of the upper zone of a first and second pair of panels joined in abutting perpendicular relationship and using support columns of the type shown in FIGS. 2, 3, 4 and 5.
Figure 13:
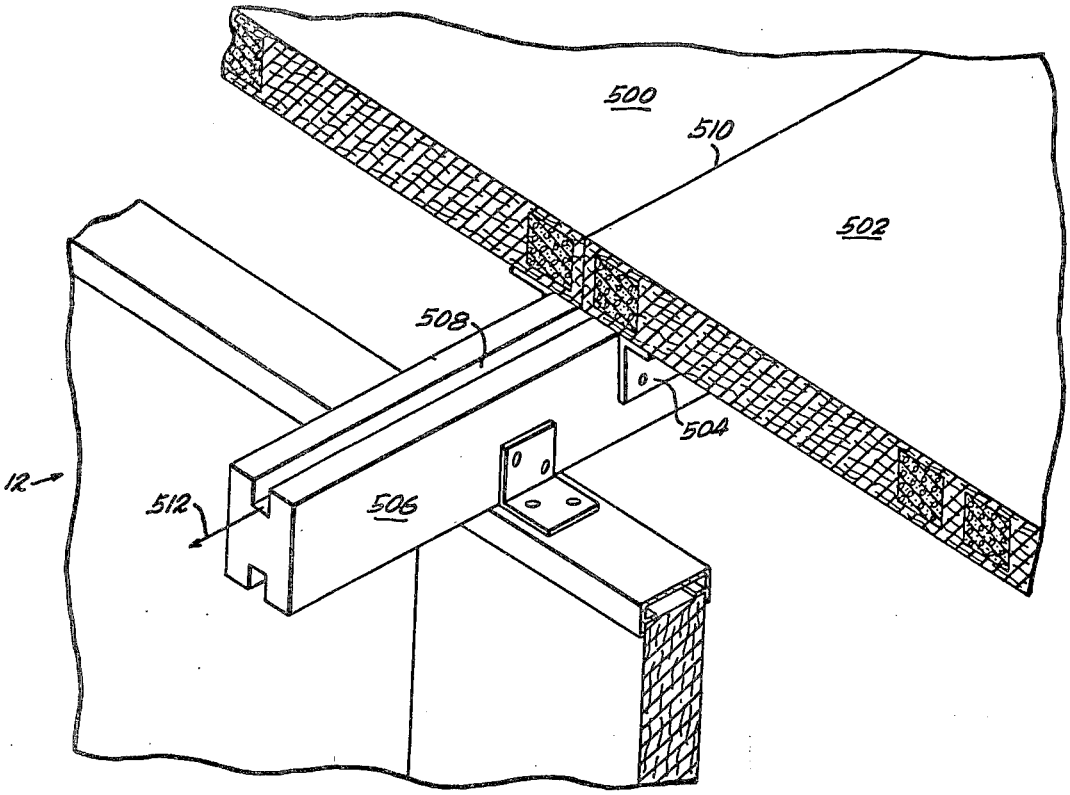
FIG. 13 is a view illustrating the panels of the instant invention utilized as roofing members.

A tie beam or cap is provided to cover the panels and to be connected to the extending upper and lower ends of the columns, see the inverted extrusion 94 having a web 96 with side flanges 98 and 100 from which there extend intermediate partial confronting ledges 102 and 104 spaced between the terminal ends of the flanges and the web 96. A similar extrusion is utilized, and hence not here redescribed in detail, at the lower end. It is noted that the confronting, leading or front edges of the ledges are spaced apart sufficiently for passage of the ends of the column into abutting relation with the inside surface of the web of the channel and, preferably, with those confronting edges in abutting relation with the column. Additionally, the ledges on the lower channel form extrusion provide a seat upon which the bottom surface of the panel dwells and is supported and, to this end, the span across the flanges is subtantially equal to but slightly greater than the distance across the panel between the main surfaces. The weight of the panels is supported on the ledges and it will be seen that the flanges in FIG. 11 which extend downwardly act as skirts to disguise any imperfection in the height of the panel between the lower surface and the top surface and that the same are not intended to transmit a load from the ledges to the upper surface of the panel, the load being transmitted from the web 96 to the upper end of the column 50. With further reference to FIG. 10, it is seen that bolts 202 and 204 may be utilized to fasten the columns and panels in position. It is thus seen that the load is adapted to be carried by the columns when a beam such as that designated by the numeral 300 is applied exteriorly to the web and fastened thereto as by the angle brackets 302 with a flange 304 secured as by the bolts 306 to the upper cap or tie beam. In this embodiment the load is carried by the column and is transferred through the column to the footing as at 306 in FIG 10. The upper cap or tie beam is generally designated by the numeral 400 and 402 in FIG. 12. In this Figure it is seen that there is an upwardly projecting portion 408 of the columns as is also shown in 410 and 412 and that the upper ends of these columns rests on the inside surface of the web while the upper surface 16 of the panel confronts the under surface of the ledges of the cap and may be in slightly spaced relation therefrom, since it is not load-bearing only acting as a diaphragm to carry lateral forces to the foundation. The panels may also be utilized as roof members as indicated by the numerals 500 and 502. In this event the same are joined together and suitably secured as by the bracket 504 in FIG. 13. This is for the purpose of supporting beams which support the panels such as 506 with a groove 508 therein, it being noted that any moisture which enters through the seam 510 will drain out through the groove 508 in the direction of the arrow 512.

Figure 14:
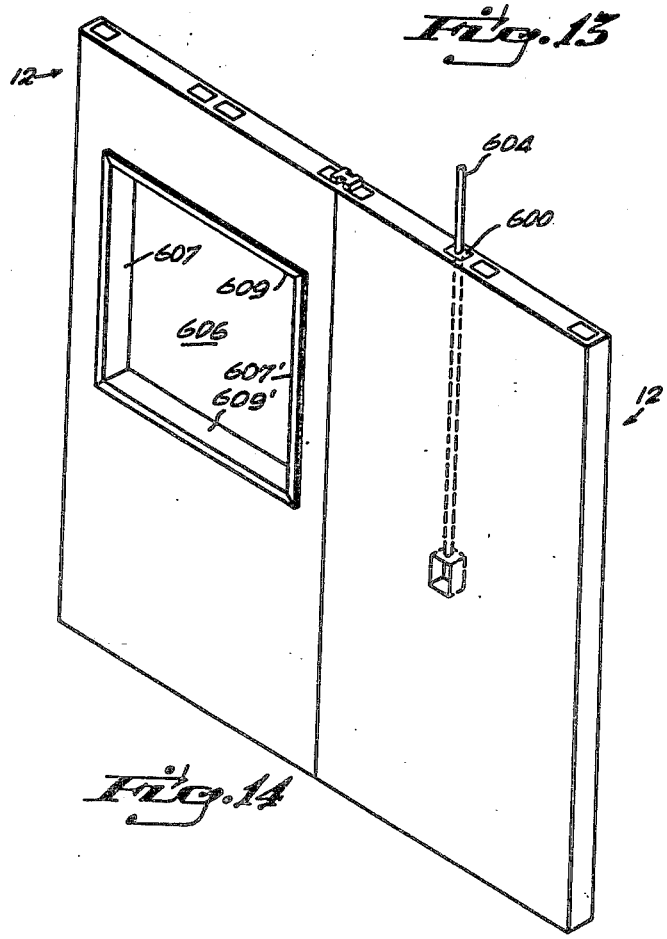
FIG. 14 is a partial view illustrating the use of the panels in a coplanar relation and utlized for an electrical conduits, socket or plumbing shaft.

Also, in the preferred embodiment, the open cell work material of the shafts, as designated by the numeral 600 in FIG. 14, may have inserted therein pipes such as 604 for electrical or plumbing purposes. Finally, the panels may be cut defining openings such as 606 to provide surface for bucks such as 607 and 609 and 607' and 609' to be utilized to define a window opening in which a window unit may be installed.

It is thus seen that there is provided a building construction wherein the gravity loads are carried by the columns and that the weight of the panels proper is supported on the ledges. This provides a simple and inexpensive and strong and sturdy construction utilizing lightweight materials available locally which are for the most part very, very inexpensive to manufacture and which can be readily assembled and molded in a manufacturing plant and finished at a job site. It is recognized that departures may be made within the scope and spirit of the invention which is, therefore, not to be limited except as set forth in the claims following hereinafter.

It will be seen that when the structural elements are hammered into place, the interior thereof is filled, in the case where the structural elements or columns are hollow which improves its structural characteristics and, additionally, as indicated in FIG. 14, when a cylindrical shaped pipe is rotated about its longitudinally extending centerline or axis and presses into the open cell material, it cuts through the material and this expandable open cell material will adhere to the inner wall and may be removed if desired. Finally, the tubular section which is filled with the open cell material, that is the shaft, may be completely removed from any panel, if desired, by simply pouring a solvent in it, which dissolves it and, thereafter, it is simply poured out of the panel leaving a longitudinally extending recess.

What is claimed is:

1. A plurality of common size panels, each panel having spaced main faces bounded by parallel sides and right angularly oriented parallel top and bottom surfaces, and each panel comprising a first main portion of relatively rigid inexpensive waste material set in a binder and a subsidiary portion composed of shafts of open cell foamed material, including one of said shafts parallel to each of said side surfaces and extending from the top surface to the bottom surface and being embedded in the main portion between the main faces;

said panels being aligned in coplanar relation with the side surfaces of adjacent panels being in abutting relation and structural waterproof connector means connecting the panels together, said structural waterproof connector means comprising an H-shaped member having a web portion extending between the faces and to the shaft adjacent the abutting side surfaces of the adjacent panels and said connector means including enlarged outer zones occupying space within the shafts; and said structural waterproof means extend vertically upwardly a common distance above the upper surfaces of the adjacent coplanar panels and a common distance below the bottom surface of the adjacent panels to receive gravity loads, and said panels do not receive gravity loads and act as diaphragm members transmitting horizontal loads.

2. The device as set forth in claim 1 wherein said waterproof connector means are structural elements in the form of H-shaped members as seen in cross section.

3. The device as set forth in claim 2 wherein said H-shaped members are of extruded metal.

4. The device as set forth in claim 3 wherein said H-shaped members are solid.

5. The device as set forth in claim 3 wherein said H-shaped members are of roll formed metal having an overlapped portion and wherein the stem of said H between said bars defines a longitudinally extending pocket and the bars are spaced from one another a distance twice as great as the distance between the side surface of the adjacent panels and the shaft and said shafts are of rectangular cylindrical form as seen in plan defining wing zones in close abutting relation in said pockets with said stem defining a water impervious barrier comprising a seam between adjacent panels.

6. The device as set forth in claim 2 wherein said H-shaped members include wall means defining a longitudinally extending hollow interior and said interior being filled with the material comprising said panel and said panel material jackets said H-shaped members.

7. A plurality of common size panels, each panel having spaced main faces bounded by parallel sides and right angularly oriented parallel top and bottom surfaces, and each panel comprising a first main portion of relatively rigid inexpensive waste material set in a binder and a subsidiary portion composed of shafts of open cell foamed material, including one of said shafts parallel to each of said side surfaces and extending from the top surface to the bottom surface and being embedded in the main portion between the main faces;

said panels being aligned in coplanar relation with the side surfaces of adjacent panels being in abutting relation and structural waterproof connector means connecting the panels together, said structural waterproof connector means comprising an H-shaped member having a web portion extending between the faces and to the shaft adjacent the abutting side surfaces of the adjacent panels and said connector means including enlarged outer zones occupying space within the shafts; and said structural waterproof means extend vertically upwardly a common distance above the upper surfaces of the adjacent coplanar panels and a common distance below the bottom surface of the adjacent panels to receive gravity loads, and said panels do not receive gravity loads and act as diaphragm members transmitting horizontal loads, said panels and connector means comprising a building construction and said building construction including tie beam means, said tie beam means including a channel form member defining a web and spaced flanges, said spaced flanges being spaced from one another a distance slightly greater than but substantially equal to the distance between the main faces of said panels and said tie beam means including a first ledge and a second ledge extending in confronting relation to one another from the flanges and the upper surface of said panels is between said ledges and said flanges and the connector means is sized to extend into abutting relation with the web and between the ledges.

8. The device as set forth in claim 7 wherein said ledges support the lower surface of the adjacent panels.

9. The device as set forth in claim 7 wherein means are provided to connect the panels to the flanges of the tie beam means.

10. The device as set forth in claim 8 wherein means are provided to connect the panels to the flanges of the tie beam means.

11. An integral molded building panel for use in combination with similar panels and elongate connector means to connect the panels together to form a building unit, said panel having parallel main faces bounded by parallel sides and right angularly oriented parallel top and bottom surfaces, said panel including a main portion of relatively rigid inexpensive waste material in parallelepipedal form set in a binder and molded about and bonded to a subsidiary portion composed of a pair of spaced premolded shafts of open cell foam material embedded in said main portion, each of said shafts having a first end, a second end, and an outer, inner, and main faces, each of said shaft main faces being parallel to and spaced a predetermined substantial common distance from one of said main faces of said panel and said outer shaft surface of each shaft being adjacent to and spaced a predetermined distance, substantially equal to said first mentioned common distance, from one of said side surface of said panel, said main portion about said embedded shafts defining a relatively thin wall portion of said rigid material jacketing the outer and main shaft surfaces of each shaft, and each of said shafts extending from the top panel surface to the bottom panel surface with said first shaft end of each shaft being part of the top surface of said panel and the second shaft end of each shaft being part of the bottom surface of said panel, said thin walls being adapted to be cut longitudinally between the top and bottom panel surfaces to remove a thin wall section to expose a portion of the open cell material between two opposing shaft faces and to define flanges of said rigid material comprising first connector means for hooked-up engagement in mutually intercooperating relation with the elongate connector means.

12. A building panel as set forth in claim 11 wherein a third similarly sized shaft of open cell material is provided and embedded in said main portion between and aligned with said pair of premolded shafts.

13. A building panel as set forth in claim 11 wherein another pair of similarly sized shafts of open cell material is embedded in said main portion between and aligned with said pair of two spaced premolded shafts, said another pair of premolded shafts being spaced from one another a distance substantially equal to twice the thickness of said thin wall portion whereby said panel is adapted to be cut into two smaller panels.

* * * * *